US005158186A

United States Patent [19]

Krut

[11] Patent Number: 5,158,186

[45] Date of Patent: Oct. 27, 1992

[54] HANGING FILE SYSTEM

[76] Inventor: Wayne G. Krut, 1234 Manor Oaks Ct., Dunwoody, Ga. 30338

[21] Appl. No.: 702,050

[22] Filed: May 17, 1991

Related U.S. Application Data

[63] Continuation-in-part of Ser. No. 582,741, Sep. 14, 1990, abandoned.

[51] Int. Cl.[5] ..... A47F 7/00

[52] U.S. Cl. ..... 211/113; 211/181; 211/45; 312/184

[58] Field of Search ..... 211/45, 46, 128, 113, 211/181, 119, 118; 312/184; 248/205.2

[56] References Cited

U.S. PATENT DOCUMENTS

| | | | |
|---|---|---|---|
| 917,170 | 4/1909 | Short | 211/119 X |
| 2,221,659 | 11/1940 | Wilkie | 211/119 |
| 2,563,226 | 8/1951 | Ellis . | |
| 3,396,731 | 8/1968 | Peebles . | |
| 3,853,364 | 12/1974 | Lundberg . | |
| 4,155,607 | 5/1979 | Sitler . | |
| 4,314,733 | 2/1982 | Smith . | |
| 4,475,660 | 10/1984 | Cain . | |
| 4,815,683 | 3/1989 | Ferrante | 248/205.2 |
| 4,901,867 | 2/1990 | Petty, Jr. | 312/184 X |

FOREIGN PATENT DOCUMENTS

| | | | |
|---|---|---|---|
| 1528621 | 6/1968 | France | 312/184 |

*Primary Examiner*—Carl D. Friedman
*Assistant Examiner*—Sarah A. Lechok
*Attorney, Agent, or Firm*—James A. Hinkle

[57] ABSTRACT

A hanging file system for use in a confined space such as on the back of a door, in a recessed wall space or in any such similar vertical space. The system includes a support system having a thin front-to-rear dimension with supporting structure providing several vertical storage areas within the filing system and allowing the storage of hanging file jackets within the thin dimension.

12 Claims, 7 Drawing Sheets

HANGING FILE SYSTEM

CROSS-REFERENCE TO RELATED APPLICATION

This Application is a continuation-in-part of co-pending application, Ser. No. 07/582,741 filed on Sep. 14, 1990, now abandoned.

BACKGROUND OF THE INVENTION

1. Field of the Invention

The present invention relates generally to the field of filing equipment, and more particularly, to a hanging filing system forming a vertical filing system which may be utilized within a confined space such as on the back of a door, such as a closet door, on a portable partition such as used to create separate office cubicles or work stations, upon suitable recessed wall space, in a cabinet specifically designed for such use, hung on a flat wall surface, from the underside of a shelf within a clothes or storage closet, or even mounted in conjunction with the interior surface of a car trunk, or in a horizontal position placed under a conventional bed.

2. Description of the Prior Art

As is well-known, filing systems of the prior art generally comprise cabinets of a size which makes these cabinets quite inconvenient and aesthetically unpleasing for use in areas where decorating decor may dictate such devices to be out of place. The typical file cabinet whose dimensions may be eighteen (18) inches or more in width, extending fore and aft three (3) feet or more and having a heighth of five (5) feet, may well prove obtrusive in a well decorated office or home.

There have been other patented filing systems which have utilized the vertical filing principle in order to save space, but such systems, by and large, combine the same drawbacks as just previously mentioned in that the systems require cabinets of some bulk which are not easily hidden from view. In addition, these vertical filing systems of the prior art generally are quite complicated and are somewhat cumbersome in their use.

SUMMARY OF THE INVENTION

In accordance with the present invention, it is contemplated that a vertical filing system will be provided which houses standard file hanging jackets and file folders of both a letter and legal size. The present invention is designed to hang on the back of any door or may be hung elsewhere such as on walls in suitable locations, on closet rods, hung from closet shelves, or, if desired, may be recessed in a wall, or may be housed in built-in cabinet suitable for the intended use. In addition, the filing system may be fitted with a back closure panel and a door system on the front of the file to completely enclose the filing system.

Due to the simplicity of the invention, the construction may be of simple means such as any suitably strong material such as metal, plastic, wood, or of a wire. Another type of construction which may well be suitable, would be a peg arrangement projecting outwardly from the mounting surface. It is anticipated that the system may be of such a width so as to accommodate at least one vertical column of either letter size or legal size file folders, or of any other size file that may be useful to an end user. If space allows, the system could well utilize a multiple width filing system which may be of any particular length to allow convenient user access. Further, file units of shorter length could be utilized and, if the situation so dictated, the shorter units could be vertically attached to one another in a daisy chain, or a single hanging file module may be either attached and daisy-chained to other hanging file modules, or independently attached to a vertical support structure, (which vertical support structure is in turn attached to a vertical surface or is supported by hanging the modules vertically), in a modular fashion to make an elongated file system to meet the needs of most users.

In actual use, conventional file folder jackets are placed within the hanging filing system and then conventional file folders of suitable size and number are placed within the hanging file folder jackets. Assuming a front to rear depth of six (6) inches in the present filing system described herein, it can be seen that a multiple level system of five (5) vertical levels would provide approximately thirty (30) inches or more of horizontal file storage space, yet would require only six (6) inches of actual horizontal space. In such a system, adequate vertical space would exist between the hanging file folder locations thereby allowing viewing of file tabs for identification, removal and insertion of files within the jackets.

It is, therefore, an object of the present invention to provide a novel and unique, vertical hanging filing system which requires very little horizontal space, may be mounted at any convenient location within a very short period of time, and is easily accessible to the user.

Another object of the invention is the provision of a hanging file system which use standard file folders and hanging jackets which are readily available in the office supply market.

Another object of the invention is the provision of the hanging filing system which, when properly mounted, maintains office files neatly out-of-sight, will mount on virtually any available door or other suitable surface thereby utilizing otherwise wasted space, and yet may be easily removed from the mounting surface, and is extremely portable.

Another object of the invention is the provision of a hanging filing system which may also be attached to a clothes closet rod or to the underside of a closet shelf, thereby making practical use of excess closet space.

A further object of the invention is the provision of multiple units of the filing system which ma be hung directly in front of one another thereby creating a greater depth of filing space.

Another object of the invention is the provision of the hanging filing system of the present invention which provides a large volume of permanent file storage at a small cost, and utilizes an extremely simple unit constructed of commonly obtained material, is easily manufactured, is relatively inexpensive, and is easily utilized by the ultimate user.

Other objects, advantages and capabilities of the invention will become apparent from the following description taken in conjunction with the accompanying drawings showing only a preferred embodiment of the invention.

DESCRIPTION OF THE PREFERRED EMBODIMENTS

Figure 1:
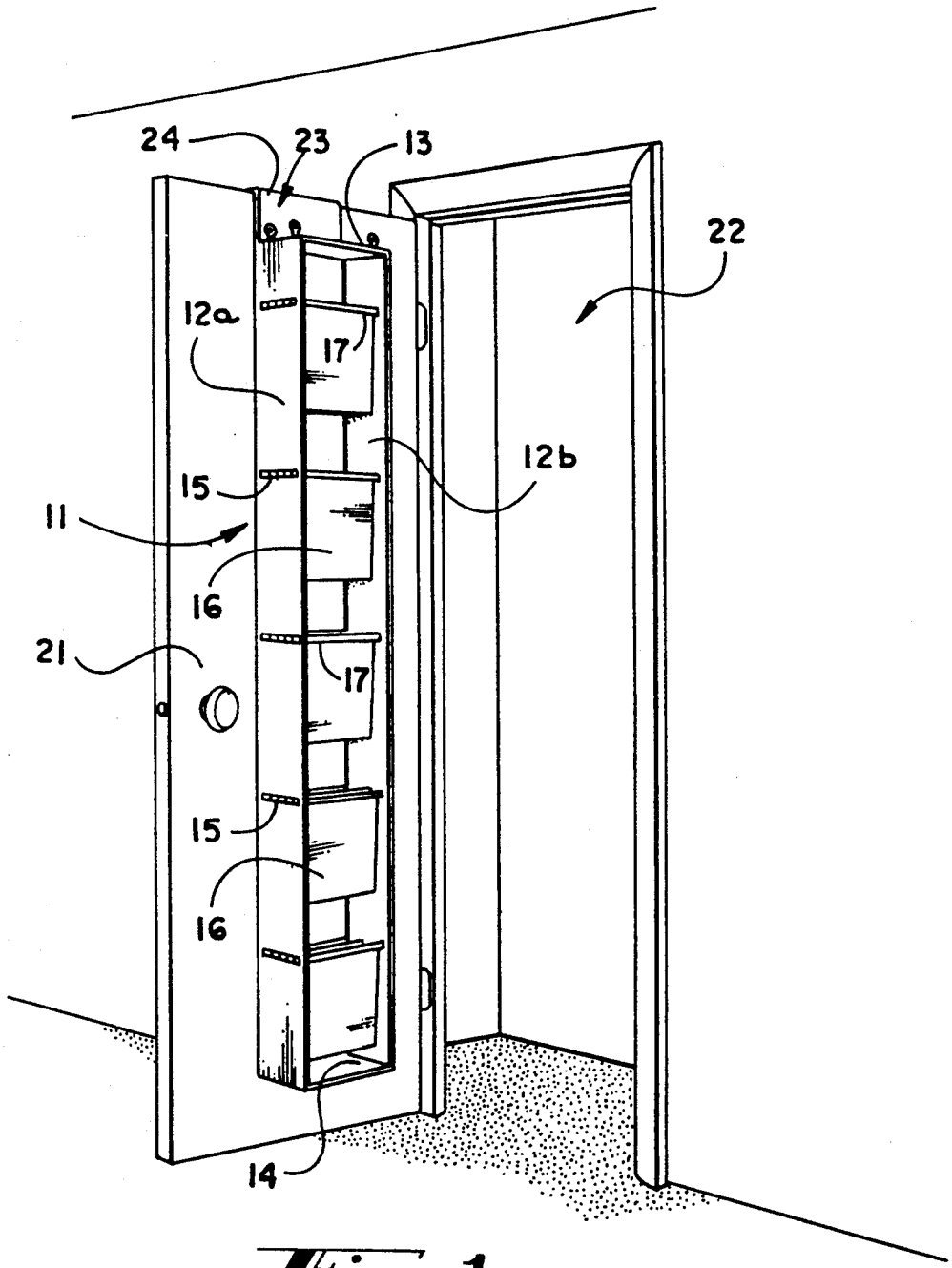
FIG. 1 is a perspective view of the present invention shown being utilized on the interior of a typical closet door.

Referring to the drawings wherein like reference numerals designate corresponding parts throughout the several figures, the hanging file system of the present invention is generally indicated by the numeral 11. As is seen in FIG. 1, the system 11 comprises a pair of elongated sidewalls 12*a* and 12*b* which are typically interconnected by a top 13 and a bottom 14, thereby forming the basic unit. If desired, the basic system 11 could be fitted with an optional back panel and optional doors on the front to fully enclose the unit. The doors are not shown in the drawings of the preferred embodiment.

While the file system 11 has been shown in the preferred embodiment as having solid sidewalls, and solid top and bottom members, it should be noted that many different types of construction could be utilized such as wood, plastic or a wire mesh design such as is utilized in display or closet shelving. It should be anticipated that any such construction technique would be applicable to the present invention. The side-walls 12*a* and 12*b* are designed to incorporate multiple slots 15 at vertically disposed locations. While the preferred embodiment describes a file system 11 having solid side walls with slots 15 therein, it should be evident that a supporting rod of suitable type could be mounted on the interior of the sidewalls to accept the hanging file jackets 16, thereby eliminating the slots 15.

Figure 5:
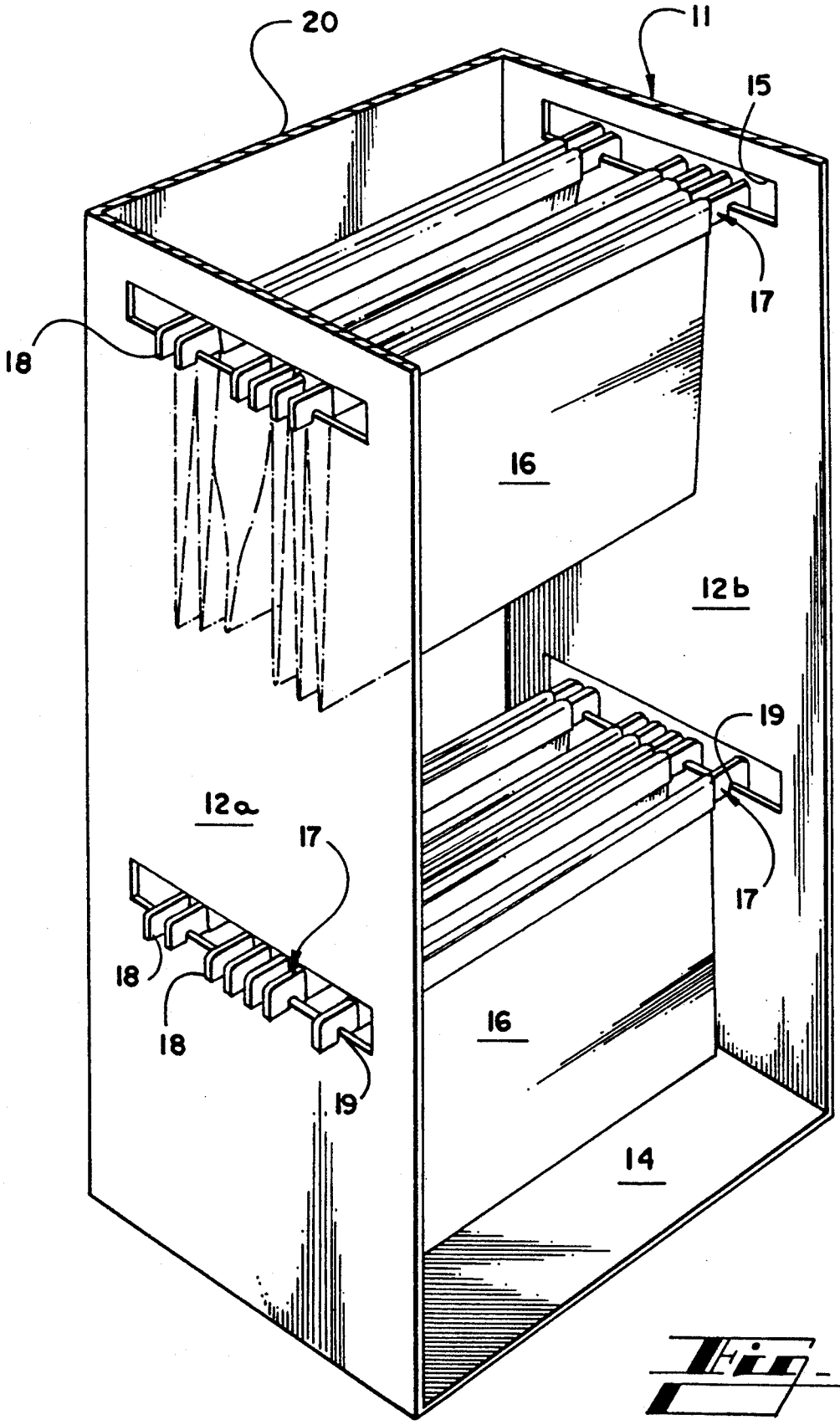
FIG. 5 is a partial perspective, close-up view of the invention showing the file jackets being suspended within the hanging file system of one particular type of construction for said system.

To cooperate with the file system 11, there would be provided multiple hanging file jackets 16, of conventional design, which have, as part of the jacket, a pair of stiffening hanger rods 17 to which the file jacket is attached at either end. Such construction forms an open-top envelope into which a standard file folder may be inserted. At each end of the folder hanger rod 17, there would normally be provided a hanger hook 18 which, when in its operative position, would have a downwardly facing notch 19 which will cooperate with the bottom edge of the slot 15 to retain the jacket in its intended hanging position in a suspended relationship with any desired vertical planar surface. The jacket 16 is easily seen in FIG. 5 hanging in its intended mode and its intended use. As shown, multiple jackets may be placed within the file system 11 and at each slot position, thereby providing several jackets at each slot position wherein each jacket could easily hold one or more common file folders therein. There would normally be a reasonable amount of distance between the vertically disposed slot positions so that the user could access the top of each jacket without disturbing the jackets in the slot position just above. In this way, the user will be able to remove file folders from the jackets quite easily without disturbing any of the other jackets. Additionally, in FIG. 5, there is shown an optional back panel 20 which provides rigidity to the unit, if necessary.

As seen in FIGS. 1–4, the hanging file system 11 of the present invention is shown being attached to the rear surface of a door 21 and, in this case, the door is indicated as being a closet door leading into a relatively small enclosure 22. However, as previously noted, the present invention is not only particularly suited to a door or vertical wall environment, but may equally be used in built-in arrangements much like bookcases, or may be built into a pantry-like enclosure where a pantry type door may be vertically hinged and the hanging file system of the present invention may be swung out in multiple stages wherein several of the file systems could well be housed in a very compact and convenient enclosure within such a wall cabinet.

Figure 2:
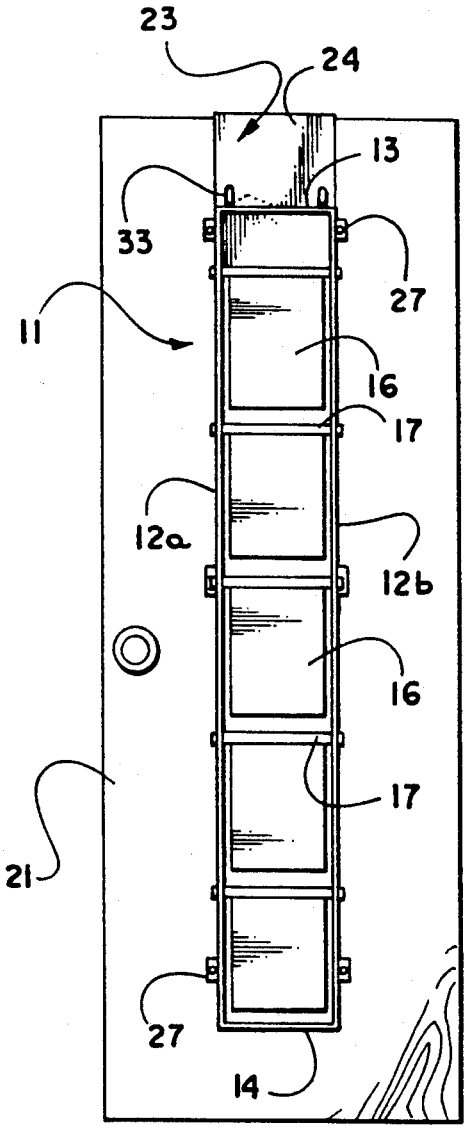
FIG. 2 is a front elevation view showing the invention being utilized on the door of FIG. 1.
Figure 3:
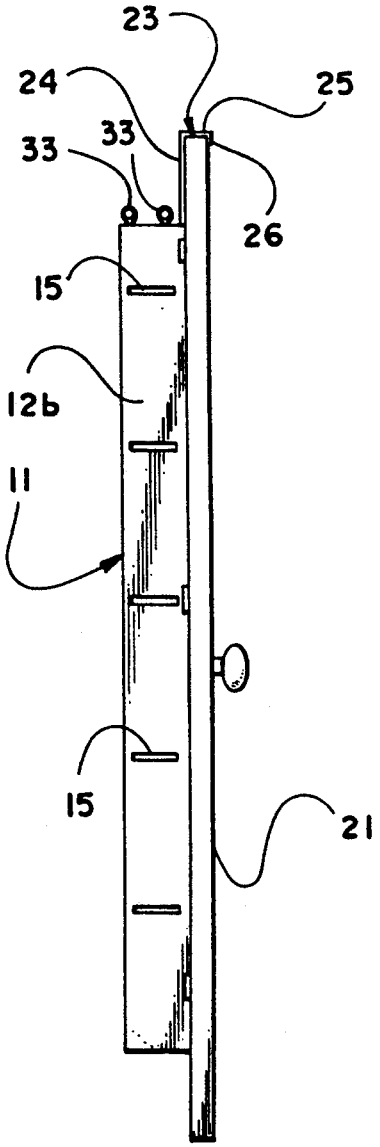
FIG. 3 is a side elevation view of the invention attached to a door.
Figure 4:
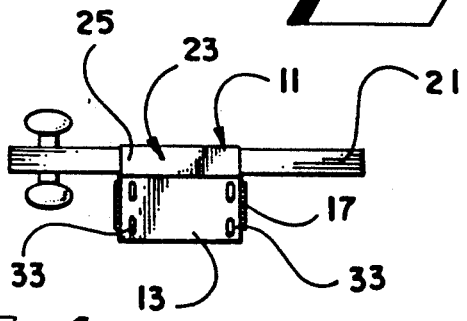
FIG. 4 is a top view of the invention attached to a door.

Any number of means may be utilized to suspend the hanging file system 11 on a door, or a wall, or other suitable mounting surface. As shown in the embodiment of FIGS. 1–4, the system is mounted upon door 21 by means of an optional hanger bracket 23 which may be of substantially L-shaped design having an extended leg 24, a base leg 25, and possibly an optional lip 26 which contacts the reverse side of the door to prevent the bracket 23 from being accidentally released from the door. Frequently the aesthetics of a mounting situation will dictate against having a lip 26 showing on the opposite side of a door. If such was the case, the lip might well be done away with and the hanging file system would be secured to the door with various other means such as screwing base leg 25 to the door top. In fact, the other mounting means may be in addition to the hanger bracket 23, or the other mounting means may be independent thereof, and the hanger bracket 23 may well be done away with depending on the desired mounting scheme. For instance, as shown in FIG. 2, optional side mounting brackets 27 are attached to the sidewalls 12*a* and 12*b* in such a manner that suitable screw fasteners may be placed therethrough into the door or other mounting surface to maintain the file system 11 suspended upon the intended mounting surface. Obviously other mounting means could be utilized, some of which may be utilized independently or may be utilized in conjunction with one or more of the just described mounting systems. For instance, instead of utilizing the side mounting brackets 27, the hanging file system might well be supplied with hook and loop fasteners which would assist the mounting of the unit on a door and yet would not deface the door with screw holes or other type of fastening means. Hook and loop fasteners, or adhesive means, may also be used to hold files against a vertical surface to prevent movement.

Figure 6:
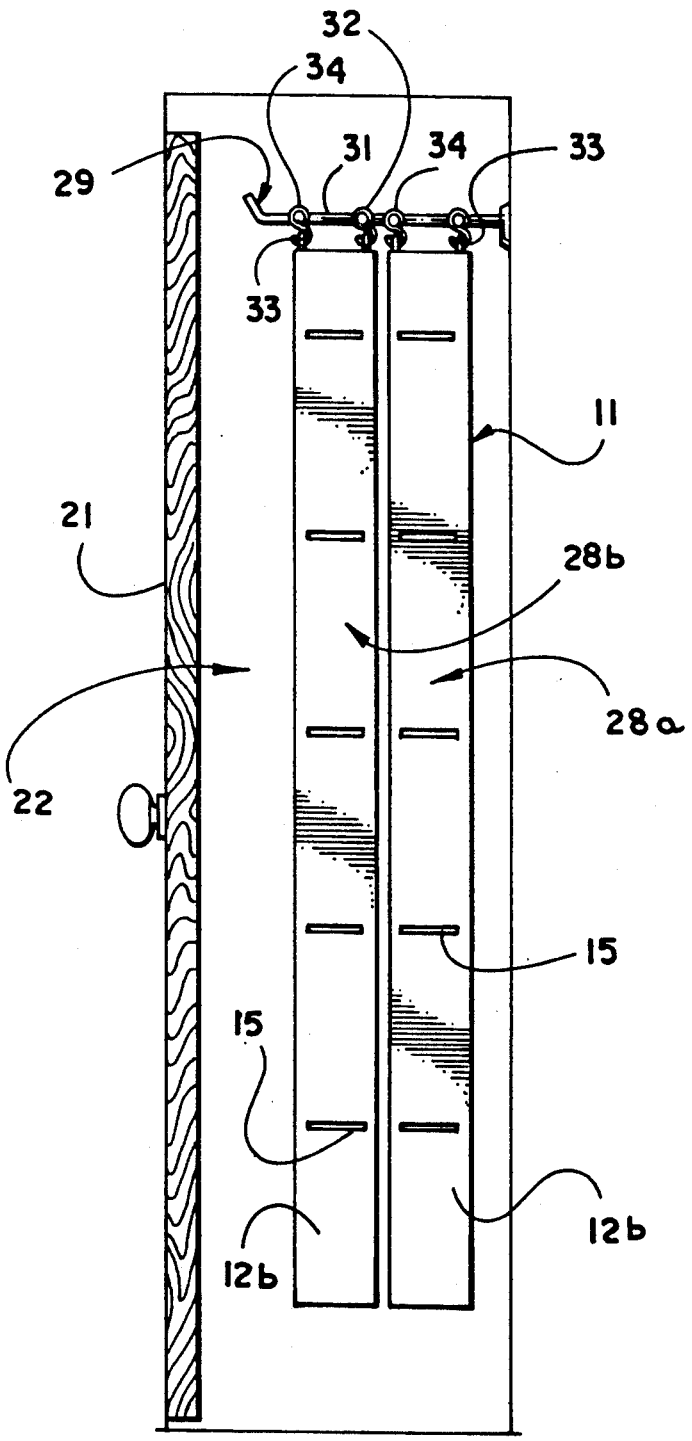
FIG. 6 is an elevation view showing the invention being utilized in a small enclosed space, and of multiple units being hung from a wire-type shelf.
Figure 7:
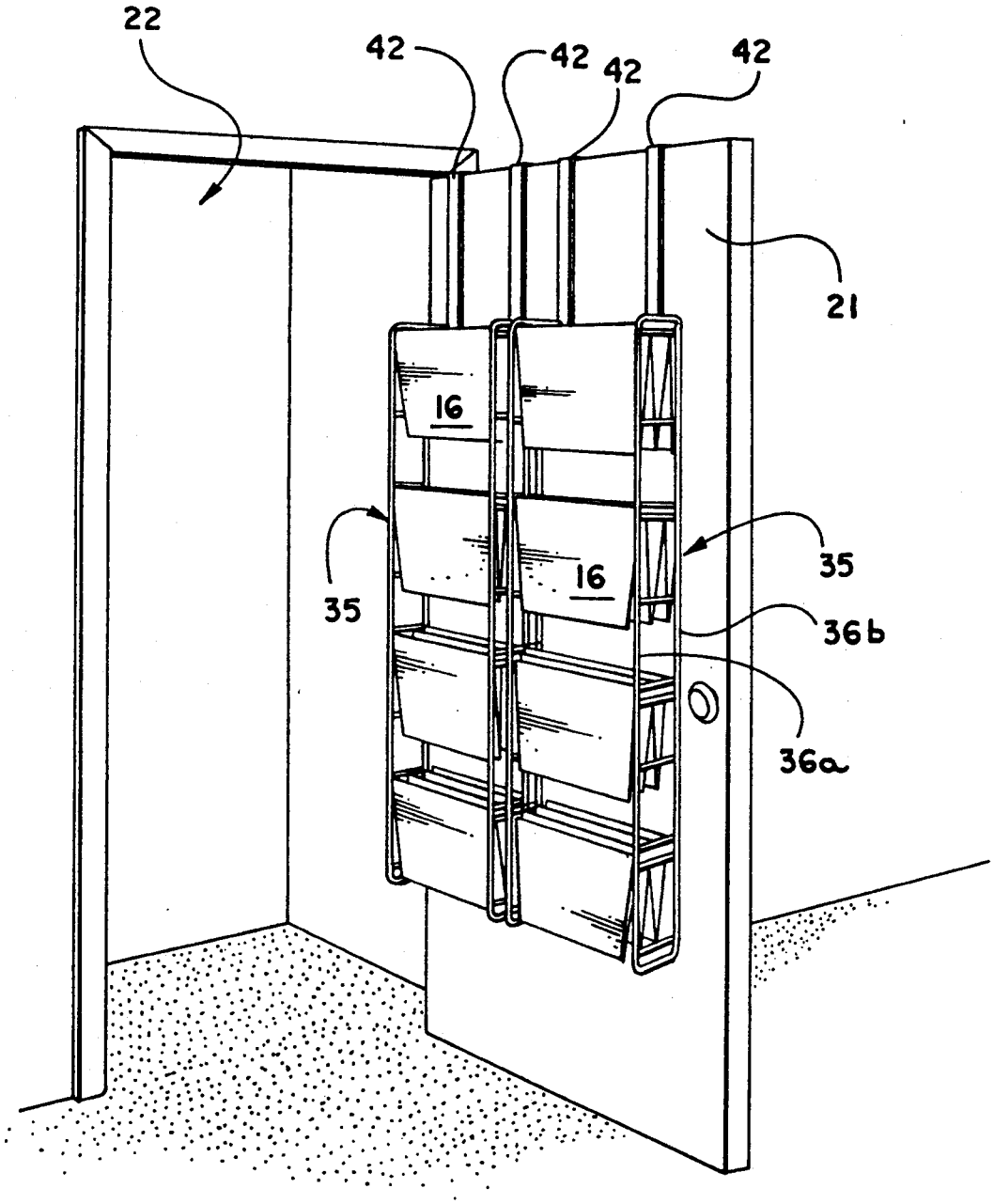
FIG. 7 is a front perspective view showing another embodiment of the invention being utilized on a closet door.

It might be desired to utilize the hanging file system 11 in conjunction with a shelf having an open-weave of wire mesh similar to that found in the typical closets of today. FIG. 6 shows an installation of the hanging file system 11 in such a closet environment in which a closet 22 is provided with a door 21 to conceal the hanging file system. The system components comprising multiple units 28*a* and 28*b*, are hung from a closet shelf 29. The members of the hanging component preferably comprise a mesh weave wire cross grid array having projecting wire supports 31 and cross wire supports 32.

At the upper end of the units 28*a* and 28*b* are located a plurality of engagement devices, shown herein as eye-type hooks 33 engaged by respective S-type hooks 34 which connect the system units to the cross wire supports 32. The wire grid system is used herein as an illustrative hanging support inasmuch as it is obvious that a solid wood shelf could be used equally well. In any event, by locating a plurality of the system units 11, one in front of the other, in a confined space such as a closet, it is apparent that a great degree of additional file storage space is achieved. If the optional back panel 20 is not utilized, it is possible to reach through the multiple units to retrieve a file from one of the units which is located rearwardly from the frontmost unit.

A further application of a shorter version of the hanging file system may be located within a trunk of an automobile, such as being hung from the underside of the trunk-lid. In this way the files may be made to recline toward a horizontal position on the trunk floor when the trunk lid is closed, and the files may be positioned in a nearly vertical position when the trunk lid is opened. This allows ample, convenient access to files while traveling in an automobile. The file may be easily transferred from the auto to the home, office, cabinet, bedroom or closet, etc., for continuing accessibility. It also permits convenient transport of the hanging file system.

FIGS. 7–11 show a modified embodiment of the hanging file system, generally indicated by numeral 35, and which is constructed of steel rod typically painted or covered by a vinyl covering to give a more finished appearance. The open frame work of the modified hanging file system 35 comprises a pair of spaced apart side rails 36 on each side of the unit. The side rails 36 are maintained apart from each other by one or more rear lateral support members 37 which span the distance between respective side rails 36. To provide additional support there is provided multiple fore and aft support rods 38 which span the distance between the respective side rails.

During manufacture of the modified system 35, the typical unit might be manufactured in either a "letter" sized unit or a "legal" sized unit. The file system 35 would need to be manufactured to fit one size or the other, because the hanging file jackets 16 are obviously of different lengths depending on whether it is a letter size or a legal size folder.

However, it has been found that, since the respective side rails 36 are identical for either size unit, the file system is expandable to either the letter or legal size. This is accomplished by having the rear lateral support members 37 configured in a sleeve mode and then fitting the ends of sleeve 37 over the sleeve support stubs 40, thereby making the system capable of being either letter or legal size depending on the length of the sleeve 37 which is supplied by the manufacturer. In addition, the sleeve 37 may be placed at varying vertical positions to allow the system 35 to be mounted at desired heights when used with hanger bars 42.

Figure 8:
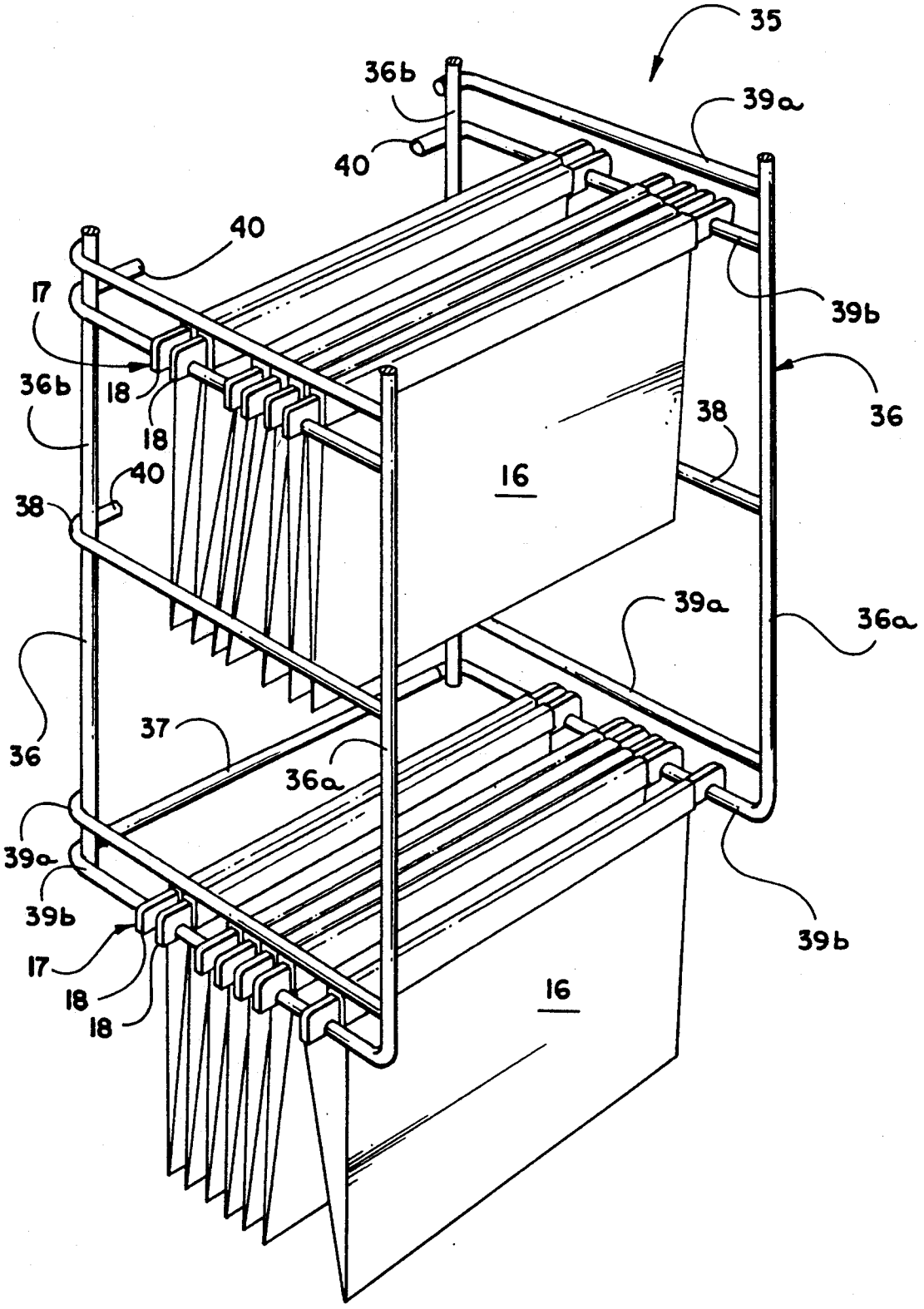
FIG. 8 is a partial perspective view of the embodiment shown in FIG. 7, and further showing hanging file folders being placed therein.
Figure 9:
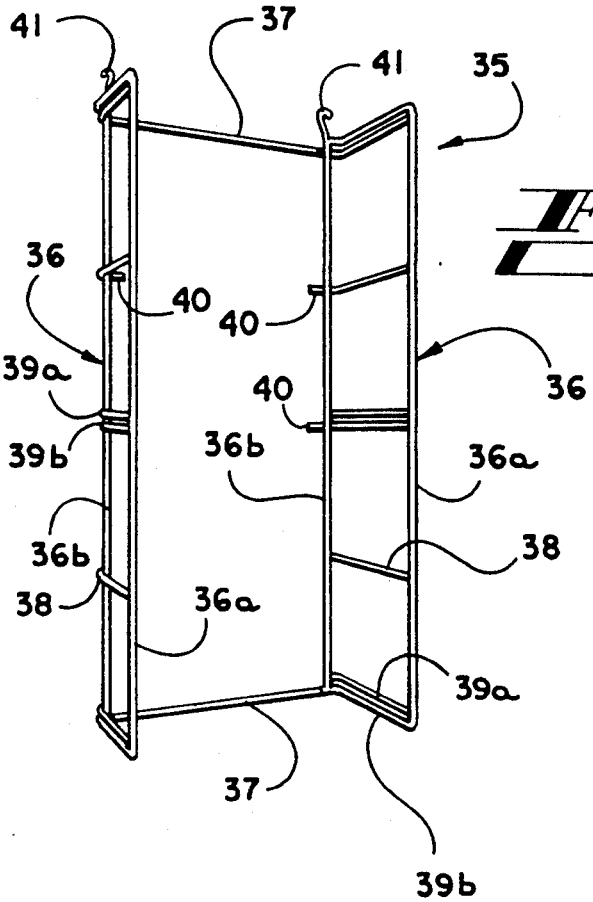
FIG. 9 is a full perspective view of the embodiment shown in FIG. 7.

When a hanging file jacket 16 is placed in the modified file system 35, the folder hanging rods 17 are designed to be supported on designated file jacket supports. The file jacket supports comprise parallel support rods 39*a* and 39*b* spaced at intervals along the vertical length of the file system 35 wherein the spacing will allow the vertical stacking of file jacket 16 in any desired number of bays. Referring to FIG. 8 which shows a detailed view of the hanging file jackets 16 being supported by the file jacket supports, it is easily seen that the jackets are hung only on support rod 39*b* and do not engage support rod 39*a*. Typically, the spacing between the file jacket support rods 39*a* and 39*b* is of such a dimension that the user of the system will be able to remove the jacket 16 from support rod 39*b* by merely twisting the rods 17 rearwardly enough so that, upon lifting the rods 17 vertically, while moving one side of rod 17 forward or backward, the tilt that was given by the user will allow the rods 17 to disengage the file jacket support rod 39*b* and to be removed from file system 35 without striking file jacket support rod 39*a*. Consequently, the true purpose of file jacket support 39*a* is to maintain the file jacket 16 upon support rod 39*b* even when the door 21 or other movable vertical surface is maneuvered in such a manner that there would be a possibility of upsetting the file jackets and causing the rod 17 to dislodge from support 39*b*. Therefore, with a provision of support rod 39*a* above the rod 17 there is little chance, because of the spacing between rods 39*a* and 39*b*, of the file jackets becoming inadvertently dislodged. Alternatively, file jackets 16 may be supported on top of rod 39*a*, or rod 39*a* may be eliminated completely, providing only single support rod.

One advantage of the present embodiment is that the length of the system 35 may be easily varied by the user. For instance, if the user of the three bay system shown in FIG. 9 would need additional hanging space, it would be a simple matter to take a pair of the three bay hanging file system shown in FIG. 9 and attach one to the other by means of hanger hooks 41. The topmost system 35 would be mounted to a door, or other suitable surface, and then the second unit would be hung from the bottom of the first unit by means of the hanger hooks 41. Depending upon the situation, several ways could be utilized to attach one unit to the other. For instance the hanger hooks might be hooked over the lowermost rear lateral support 37, or the hanger hooks might well be attached to one of the file jacket support rods 39*a* or 39*b*. In either instance the hanging of one unit to the other is essentially the same. Of course, the manufacturer of the present invention might well decide that a four or five bay system might be very practical and would manufacture file systems 35 with additional bays as needed thereby eliminating the need of attaching one system to the other by means of hanger hooks 41.

Figure 10:
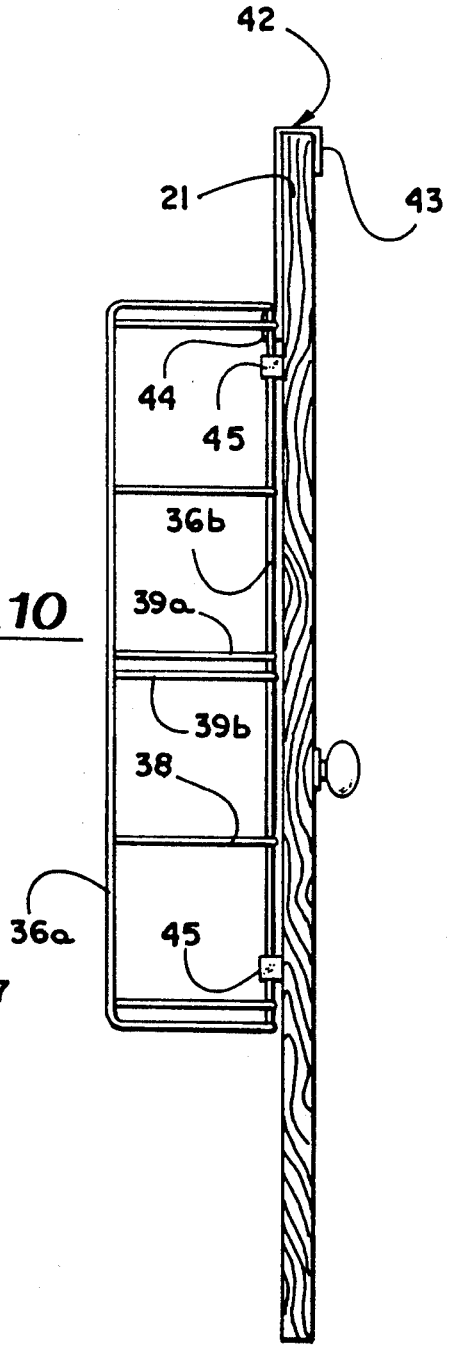
FIG. 10 is a side elevation view of the embodiment shown in FIG. 7 as it may be mounted on a door.
Figure 11:
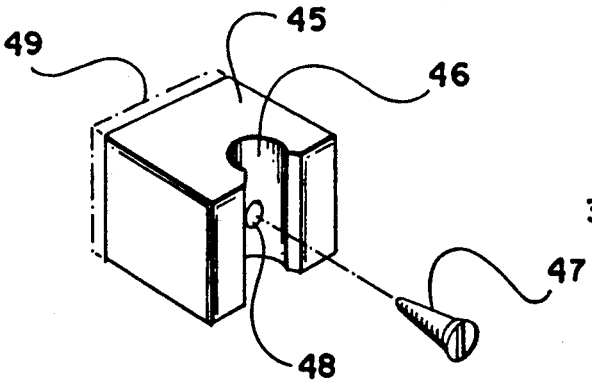
FIG. 11 is a perspective view of stand-off bumper which is used in the manner shown in FIG. 10.

It is obvious that some means must be made for attaching the modified file system 35 to a vertical surface and, to this end, there are several methods which may be utilized. For instance if the system is to be hung over a door such as is shown in FIG. 10, it may well be practical to provide a hanger bar 42 which at one end thereof would have either an L-shaped hanging member, or a U-shaped hanging member as indicated by numeral 43. If the decorating decor is such that the projecting lip of the U-shaped hanger 43 is unattractive, as it may show over the door and to the interior of the room, then the distal lip of the U-shaped hanger could be eliminated leaving only an L-shaped hanger hung over the door and it would then be possible that a fastening device such as a nail or screw (not shown) could be placed through the short leg of the L into the top of the door. The proximal end of the hanger bar 42 is designed to have an upturned U-shaped hanger portion 44 which is adapted to accept the uppermost rear lateral support 37 therein to maintain the file system 35 in its desired position on the vertical surface.

Normally it is desirable to maintain the file system 35 from contact with a vertical surface so that upon swinging of a door, or like member, the file system does not scrape against the vertical surface. To this end it is anticipated that a bumper 45 will be provided so that it may be placed at spaced intervals along side rail rod 36*b*. The bumper could also be placed in conjunction with rear lateral supports 37 as the situation may dictate. The bumper generally comprises a box-like structure having on one surface thereof a rounded slot 46 which is open to the exterior of the bumper and which is designed to matingly engage with the side rail rod or the rear lateral support when the bumper is to be utilized. The user would normally snap the bumper on to the rail and the bumper would then provide a certain standoff distance between the file system 35 and the vertical surface to which the system is mounted. At times it ma be desirable to fixedly mount the bumper 45 to the vertical surface and, to this end, a screw 47 will be placed through a hole 48 in the bumper into the door 21, or other vertical surface, thereby fixedly mounting the bumper in a desired location. At other times if it would be desirable not to use a screw to mount the bumper such other mounting means might include adhesive material or a hook and loop fastener type material of suitable type. Of course, the adhesive or hook and loop fastener would be affixed to the rearmost surface of the bumper as is generally indicated by the broken lines 49 in FIG. 11.

The present invention has disclosed a hanging file system which fits in any closet or suitable vertical space providing an out-of-sight and/or off the floor filing system, utilizing what heretofore has most usually been wasted space. Further, the system presented herein is inexpensive, requires little installation knowledge and needs no floor space, but yet eliminates unsightly filing cabinets and provides convenient access to the user of a light, strong and extremely durable filing system.

Various modifications may be made of the invention without departing from the scope thereof and it is desired, therefore, that only such limitations shall be placed thereon as are imposed by the prior art and which are set forth in the appended claims.

What is claimed is:

1. A hanging file system for use in a confined space and adapted to be placed against a vertical planar surface, the file system including multiple file jackets having elongated arms with notched ends for support purposes, the improvement comprising:

vertically disposed support means located adjacent to and in juxtaposition with the vertical planar surface, the support means adapted to cooperate with the notched ends of the file jackets to maintain the file jackets in a suspended relationship with the vertical planar surface, the vertically disposed support means further includes means projecting from the vertical planar surface to form support members upon which the notched ends of the file jackets are placed to maintain the file jackets in the desired operative relationship with the vertical planar surface, the vertically disposed support means further including a pair of opposed elongated substantially flat side support members, a plurality of elongated apertures in the side support members into which the notched ends of the file jackets are placed to suspend the jackets in a desired operative relationship with the hanging file system, means to support the hanging file system on the vertical planar surface, the means to support the hanging file system on the vertical planar surface includes an L-shaped hook member attached at one end thereof to the vertical disposed support means, the other end of the L-shaped support member adapted to overlie a portion of the vertical planar surface to thereby maintain the hanging file system in a supported relationship with the vertical planar surface, wherein the hanging file system is maintained in a confined, limited space and has a limited horizontal projection from the vertical planar surface.

2. The hanging file system as claimed in claim 1 wherein the vertically disposed support means are maintained in operative relationship with the vertical planar surface by means of brackets mounted in juxtaposition with the vertically disposed support means and fastened to the vertical planar surface by means of fasteners.

3. A hanging file system for use in a confined space, the file system including multiple file jackets having elongated arms with notched ends for support purposes, the improvement comprising:

an enclosure having a pair of side members, a top member and a bottom member, the side members adapted to cooperate with the notched ends of the file jackets to maintain the file jackets in a suspended relationship with the enclosure, means attached to the enclosure to support the file system from a supporting surface, the means attached to the enclosure to support the file system comprises fasteners to hang the file system in a vertical position, wherein the fasteners attach the top member of the file system to a supporting structure, wherein the hanging file system is maintained in a confined, limited space and has a limited horizontal projection from the supporting vertical surface.

4. The hanging file system as claimed in claim 3, wherein a plurality of the hanging file systems are hung one behind the other from the supporting structure.

5. A hanging file system for use in a confined space and having limited horizontal projection from a vertical surface, the file system including multiple file jackets having elongated arms, the elongated arms having notched ends for support purposes, the improvement comprising:

an enclosure having a pair of spaced apart side rail members, each side rail member comprising a front and rear support rod lying in a common plane, at least one file jacket support connecting the front support rod to the rear support rod, the file jacket support being so disposed to hang the notched ends of said file jackets thereon to maintain the file jackets in a suspended relationship with the enclosure, means attached to the enclosure to support the file system from a vertical supporting surface, wherein the hanging file system is maintained in a confined, limited space and has a limited projection from the supporting surface.

6. The hanging file system as claimed in claim 5, the rear support rod of each side rail having at least one sleeve support stub projecting substantially perpendicular from the rear support rod and from the plane of this side rail member, sleeve means telescopingly engaged with the respective sleeve support stub to provide lateral support to the side rail members.

7. The hanging file system as claimed in claim 6, wherein the rear support rod of each side rail has multiple sleeve support stubs projecting therefrom, multiple sleeves connecting respective opposed pairs of the sleeve support stubs to provide multiple lateral supports to the side rail members.

8. The hanging file system as claimed in claim 7, wherein the file jacket support comprises a pair of parallel disposed rods connecting the front support rod to the rear support rod, the parallel file jacket support rods being located with respect to one another so as to loosely maintain the notched ends of the file jacket arms therebetween.

9. The hanging file system as claimed in claim 8, the file system having means to attach the enclosure to a supporting surface.

10. The hanging file system as claimed in claim 9, wherein the attachment means comprises means to support the hanging file system on the supporting surface including an L-shaped hook member attached at one end thereof to the supporting means, the other end of said L-shaped support member adapted to overlie a portion of the supporting means to thereby maintain the hanging file system in a supported relationship with the supporting surface.

11. The hanging file system as claimed in claim 9, wherein the attachment means comprises a cubical bumper having an elongated slot therein configured to the shape of the side rail members and being removably joined thereto, means for affixing the bumper to a supporting surface to maintain the file system in juxtaposition therewith.

12. A hanging file system for use in a confined space and having limited horizontal projection from a vertical surface, the file system including multiple file jackets having elongated arms, the elongated arms having notched ends for support purposes, the improvement comprising:

an enclosure having a pair of spaced apart side rail members, each side rail member comprising a front and rear support rod lying in a common plane, at least one file jacket support connecting the front support rod to the rear support rod, the file jacket support being so disposed to hang the notched ends of said file jackets thereon to maintain the file jackets in a suspended relationship with the enclosure, the file jacket support further comprising a pair of parallel disposed rods connecting the front support rod to the rear support rod, the parallel file jacket support rods being located with respect to one another so as to loosely maintain the notched ends of the file jacket arms therebetween, means attached to the enclosure to support the file system from a vertical supporting surface, wherein the hanging file system is maintained in a confined, limited space and has a limited projection from the supporting surface.

* * * * *